United States Patent [19]

Wengenroth et al.

[11] 4,165,817

[45] Aug. 28, 1979

[54] FILLED PLASTIC CASK SEALED WITH A COVER

[75] Inventors: Hans E. Wengenroth, Oberottmarshausen; Wilfried Mrusek, Bellheim, both of Fed. Rep. of Germany

[73] Assignees: Chemische Fabrik Pfersee GmbH, Augsburg; Elbatainer Kunststoff-und Verpackungsgesellschaft mbH, Ettlingen, both of Fed. Rep. of Germany

[21] Appl. No.: 929,889

[22] Filed: Jul. 31, 1978

[30] Foreign Application Priority Data

Aug. 3, 1978 [DE] Fed. Rep. of Germany ..... 2735038

[51] Int. Cl.[2] ..... B65D 51/18

[52] U.S. Cl. ..... 220/256; 220/373

[58] Field of Search ..... 220/256, 257, 258, 266, 220/373

[56] References Cited

U.S. PATENT DOCUMENTS

| | | | |
|---|---|---|---|
| 3,537,610 | 9/1968 | Bilon | 220/258 |
| 4,101,047 | 7/1978 | Greppert et al. | 220/258 |

*Primary Examiner*—George T. Hall

*Attorney, Agent, or Firm*—Sprung, Felfe, Horn, Lynch & Kramer

[57] ABSTRACT

A filled synthetic plastics cask is sealed with a cover and into the interior of which there projects a preformed flexible plastic film. The film is impermeable to liquid but permeable to gas and is disposed between the cover and the upper rim of the cask. The film is folded in the rim zone of the cover such that upper and lower capillaries are formed. The cask is virtually sealed tight against egress of liquid. But the upper capillaries permit the escape of gas which has penetrated from the contents through said plastic film.

6 Claims, 2 Drawing Figures

FILLED PLASTIC CASK SEALED WITH A COVER

Figure 1:
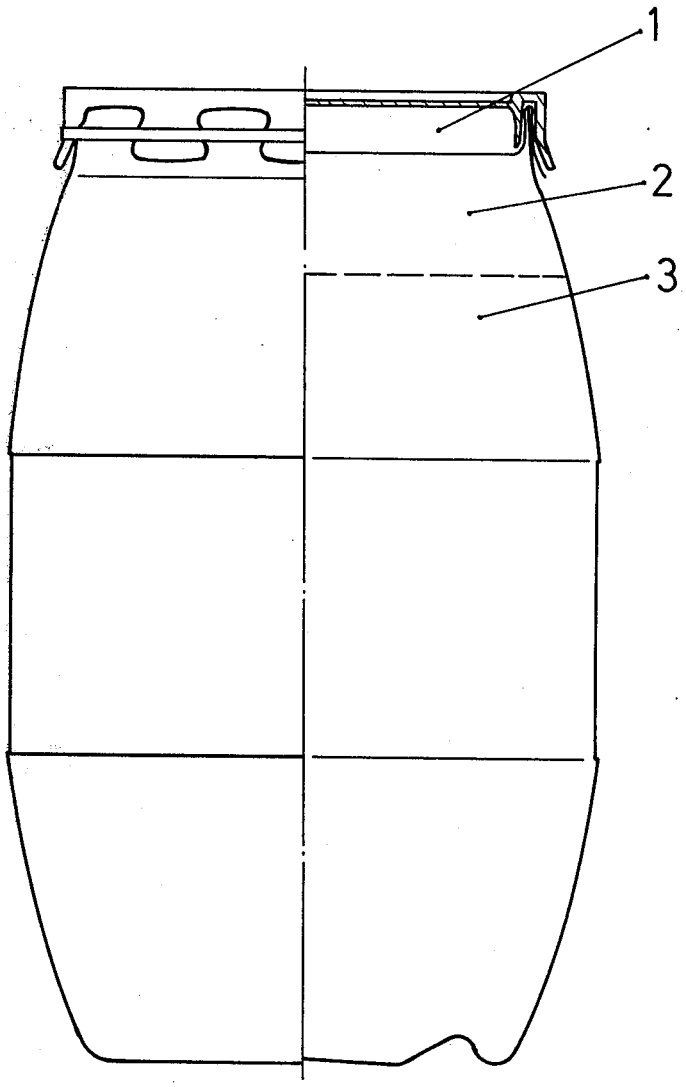

The present invention relates to a filled plastic cask sealed with a cover.

The packaging, storage and transportation of goods, especially liquid goods, in casks sealed with a cover, is widely prevalent. These casks can be made of a very wide variety of materials. Earlier, wooden casks were chiefly used, whereas today almost without exception casks are made of synthetic plastics materials, especially low-pressure polyethylene.

It is already known to use covers lined with polyethylene film, especially wooden covers, for sealing the casks in order to protect the contents from contamination by the materials of which the cover is made.

It is also known to provide the cover with valves in order to make a pressure equalisation possible during storage. These valves are relatively expensive and in addition have the disadvantage that they easily become clogged because of the narrow channels and capillaries provided and are thus rendered ineffective.

Finally, it is known to provide the cover with an elastic film which projects beneath the surface of the cover into the interior of the cask. The variation in the volume of air between the sealing ring of the cover and the elastic film is attained according to this prior art by means of boreholes in the sealing ring. During outdoor storage of the casks, the accumulation of water between cover and film creates considerable drawbacks.

It is the object of the present invention to avoid the disadvantages of the prior art.

The present invention provides a filled synthetic plastics cask which is sealed with a cover and into the interior of which there projects a preformed flexible plastic film which is impermeable to liquid but permeable to gas and is so disposed between the cover and the upper rim of the cask that the air space between said cover and the contents of said cask is divided and the film is folded in the rim zone of the cover such that upper and lower capillaries are formed, said lower capillaries substantially permitting no egress of the contents and said upper capillaries permitting the escape of gas which has penetrated from the contents through said plastic film from inside the cask and also enabling an internal pressure equalisation from outside.

Particularly preferred plastic films are bag-shaped films the diameter of which have specific measurements with respect to the inside diameter of the filled plastic casks. The preformed plastic film consists of a tubular, cylindrical, gas-permeable plastic film having a circular cross-section and being sealed at one end with a circular plastic film, said circular cross-section being equal to or greater than the inside diameter of the mouth of the cask, and the preformed plastic film, after insertion into the filled cask, being clamped at the open end between the cask rim and the cover.

At the present time, casks made of synthetic plastics, especially those made of low-pressure polyethylene (see Ullmanns Encyclopädie der technischen Chemie, 3rd edition, vol. 14, Verlag Urbon & Schwarzenberg, Munich-Berlin, 1963, page 148 ff.) are used for the storage and transportation of solid, in particular liquid, substances, especially whenever large capacity vessels, such as containers and tankers, are not suitable. The covers of these casks are also made of similar material. The casks and covers vary considerably in shape, but it is a feature of all casks that they have a round mouth.

The covers are usually not flat, but because of the need to increase the tightness and stability have different profiles having sealing means integral therewith, so that in general the rim of the cask projects into a peripheral groove in the underside of the cover.

According to the invention, the air space between the contents of the cask and the cover is divided by means of a preformed, in particular a leaf-shaped or most preferably, a bag-shaped plastic film. Because of the desired properties of the film, especially softness and flexibility, the use of high-pressure polyethylene film is preferred (see Ullmanns Encyclopädie der technischen Chemie, ibidem, page 138 ff.). In addition, polypropylene films are also particularly suitable on account of their high strength. In general, all manmade plastic films are suitable which fulfill certain minimum requirements in respect of ultimate tensile strength, elongation, and gas-permeability, for example polyvinyl chloride film, polyamide film, polyvinylidene chloride film and polyethylene terephthalate film (see Ullmanns Encyclopädie der technischen Chemie, loc. cit., vol. 7, pp. 650–655). The thickness of the films can vary within wide limits. In general, films having a thickness of 0.01 mm, in particularly 0.03 to 0.3 mm, depending on the strength of the material employed, are very suitable. However, within the scope of the invention it is also possible to use films having a thickness of 0.5 mm and more. The films are the conventional preformed plastic films which, on account of the cask construction, are advantageously circular in shape, in particular bag-shaped.

A number of different problems arise in the storage and transportation of goods, especially liquid substances, packed in casks. For example, when casks are filled with hot substance, it must be expected that cooling will cause the formation of a partial vacuum in the cask. The cask becomes deformed and its stability, especially storability, is impaired, because of the reduction in the resistance to compression. Conversely, it is only to be expected that, if the cask is filled with cold substance which later warms during storage or transportation, excess pressure will build up, which, in particularly extreme cases, can result in the cover being blown off the cask. It will, of course, also be understood that the excess pressure or partial vacuum formed in the cask is to a large extent dependent on the nature of the contents, i.e., if the contents have a high vapour pressure, then the problems referred to above must be expected to arise to a correspondingly increased degree.

A further problem arising in the storage and transportation of substances packed in casks is the possible development of gas from the contents. The causes of such gas development are many and varied. If no provision is made for the gas to escape from the cask, then in the nature of things the cask will burst.

According to the invention, the above problems are solved by dividing the air space of the cask, which is usually filled to a maximum capacity of 96%, and, if the contents are dangerous, to a maximum capacity of 92%, by means of a preformed leaf-shaped plastic film. The leaf-shaped plastic film, the diameter of which is at least 1.20, in particular 1.50, times the diameter of the mouth of the cask, is laid on the cask and pushed by the cover described above into the cask, so that the air space above the contents is divided into a larger air space between the contents and the plastic film and a smaller air space between the plastic film and the cover. The plastic film is thereby clamped between the sealing means of the cover and the rim of the cask. It is important in this connection that the plastic film is not sheared off by the cover, but remains undamaged. This can be accomplished by cask and cover constructions which are conventionally known in the art.

The film is not laid evenly on the rim of the cask, but in such a manner that more or less large folds are formed. In the case of the contents being liquid these folds are substantially sealed from underneath, i.e., from the contents side, by components thereof, and the cask is thus virtually sealed tight against egress of liquid. From above, i.e., from the cover side, these folds form more or less fine channels and capillaries which permit a slow gas exchange with the atmosphere. If the contents of the cask contain no dissolved or emulsified constituents, then the cask is still so well sealed that the contents can only leak out dropwise should the cask fall over.

The build-up of excess pressure in the cask is avoided through the gas diffusing from the air space above the contents through the plastic film into the upper air space and escaping from there into the atmosphere via the free channels and capillaries. Conversely, a partial vacuum can be equalised by air passing from the ambient atmosphere through the channels and capillaries into the upper air space and from there into the lower air space. The plastic film thus virtually seals the cask tight against the egress of liquid but is permeable to gas.

A particular embodiment of the invention resides in the feature that the plastic sheet is not pushed into the drum by the cover alone, resulting in the formation of an upper smaller air space and a lower larger one, but that it is additionally pressed downward, for example by hand, so as to form an upper larger air space and a lower smaller one. In addition to providing the desired possibility of pressure equalisation (see above), the shock and fall resistance of the filled cask is thereby substantially improved. The upper larger air space probably acts as a variable air cushion, so that the stability of the filled cask to free fall is substantially improved. A further problem in the storage and transportation of filled casks can thereby be eliminated. To form a larger upper air space and a smaller lower one, there is preferably used a plastic film in the form of a round-bottomed bag or a deep-drawn moulding, as such a film can be easily inserted into the cask. The procedure is that the bag-shaped plastic film is inserted into the filled plastic cask, the overhanging tubular part of the sack is folded over the rim of the cask, clamped by the cover and held fast by a locking means.

According to the invention, the bag-shaped plastic films are tubular, cylindrical, gas-permeable plastic films having a circular cross-section and which are sealed at one end with a round plastic film. The circular cross-section is the same or greater than the mouth of the cask. Particularly preferred tubular films are those having a diameter which is 1.01 to 1.30 times larger than the inside diameter of the cask. Particularly preferred films of this kind are in turn those having a diameter of 1.1 to 1.25 times greater than the inside diameter of the cask. The upper limit of the cross-sectional area of the plastic film is determined on the one hand by the increasing number of folds which are formed by folding the tubular, cylindrical part of the plastic film over the rim of the cask, and consequently by the danger that the cask can no longer be sealed tight, and on the other, by the excessive requirement of material. In general, the upper limit for the cross-section of the tubular plastic film is 1.75 times the inside diameter of the cask.

The level to which the tubular, cylindrical, gas-permeable plastic film extends inside the cask is not critical. The lower limit is dependent on the level of the contents of the cask and is in general about 0.08 cm, it is assumed that the cask will be filled to a maximum level of 5 cm below the rim. The upper limit will be determined by economic considerations. In view of the fact that casks are filled on average up to a capacity of 90 to 95%, the level will be limited to a maximum of 0.35 m. The height of the tubular cylindrical parts will preferably be 0.10 to 0.25 m.

The bag-shaped plastic films are obtained in known manner. It is therefore possible to obtain them by deep-drawing. However, this method is less preferred, as it results in the formation of plastic films of differing thickness, and it is also relatively expensive. The tubular part of the film is therefore preferably welded to the round part, the diameter of which latter is only very slightly larger than that of the tubular part, to form a bag. This round-bottomed bag is used for the purpose of the present invention. There is thus provided an inexpensive method which, in addition, makes it possible to obtain bag-shaped plastic films of equal thickness both in the tubular and in the bottom part, with only slight deviations.

Compared with the prior art, the cask of the present invention simplifies storage considerably and saves greatly on costs. Instead of providing two different covers—one with and one without a valve—it is now possible to manage with only one cover, and provision is made for the necessary pressure equalisation by simply introducing into the cask an inexpensive preformed plastic film. In addition, compared with the built-in valve, the plastic film of the present invention is not susceptible to failure. Whereas it happens continually that valves become clogged and the disadvantages recited above arise, and in extreme cases the covers are even blown off the casks, comprehensive tests have shown that the problem of pressure equalisation has been completely solved by the present invention and no more problems occur in this respect. Furthermore, costs are avoided because the complicated cleansing, especially of the valves and also quite generally of the cask cover, is not necessary.

It is particularly advantageous to insert a preformed plastic film in such a manner that the upper air space becomes larger than the lower one. In addition to the advantages recited above, this feature affords the further considerable advantage of an improved shock resistance of the filled cask, which means that the cask survives a free fall a height without damage. This advantage is of very considerable importance in practice, for large plastic casks do not at present withstand a free fall of one meter and over without damage to the cask itself, the cover, and the contents, but according to the preferred embodiment of the invention such a free fall is got over without said damage. A height of 1 meter and over is of critical importance in practice, as loading racks and the floor space of trucks and freight cars have a height of 1 meter and the methods of testing the fall resistance of casks are generally based on a height of 1.2 meters. The improvement in the fall resistance according to the preferred embodiment of the invention is, surprisingly, so pronounced that even weaker types of cover can be used and the cask still withstands a fall from a height of 1.20 meters without damage.

The present invention is of importance for the storage and transportation of liquid substances. All liquid substances are possible, especially those which cause the folds of the plastic film to be sealed from below. By way of example there may be mentioned: emulsions, dispersions and solutions of a very wide variety of substances, such as silicones, paraffins, synthetic resins, inorganic minerals, polymers, fats, waxes and natural substances. Aside from these, the casks can also be filled with pure solvents or other liquid substances.

Following is a brief description of the drawings which accompany this application:

FIG. 1 shows a round, partially cylindrical cask, the left side showing the topview on the cask and the right side showing the profile. In the profile, the cover, the polyethylene film (solid line) and the surface (broken line) of the content (3) can be seen. By the polyethylene film, the air space between the cover and content is divided into an upper smaller air space (1) and a lower larger air space (2).

Figure 2:
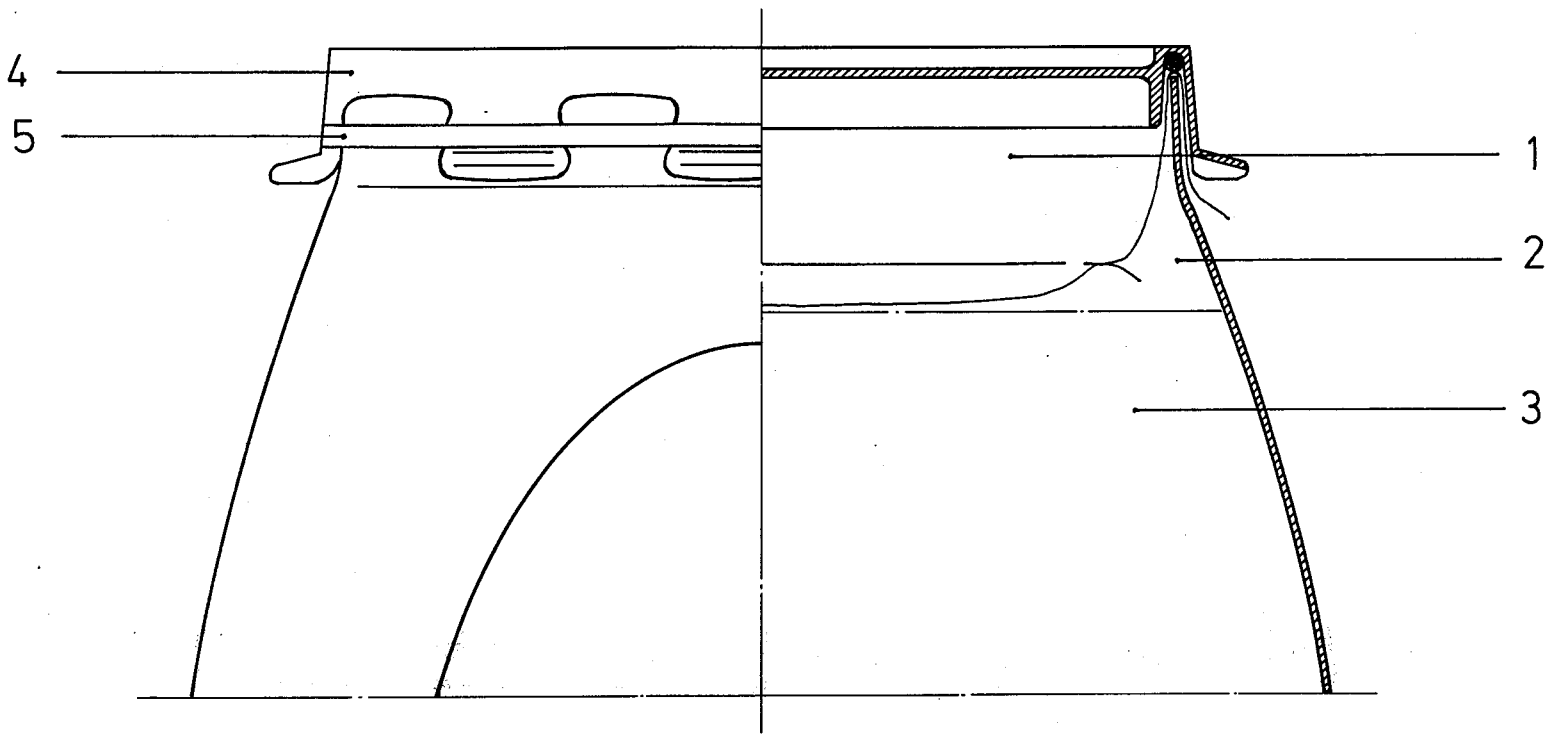

FIG. 2 shows the upper part of a cask levelled at the side, with the top view on the levelled side being represented on the left and a profile through the cask on the right. In the top view (left side), the cover (4) and the tension ring (5) are shown. In the profile, the upper larger space between cover and polyethylene film (1) and the lower smaller air space (2) between film and surface of content are shown. The broken line represents the surface of the content (3). On the level (2) runs the weld seam of the inserted polyethylene film in the form of a sack.

EXAMPLE 1

The following two tests were carried out to illustrate the effects of a polyethylene film during the cooling of the hot contents of a cask.

60 liter polyethylene casks were filled to a capacity of 55 liters with ordinary water (3) heated to 80° C. The casks were then sealed with (A) a leaf-shaped 0.1 mm polyethylene film (the film has a diameter of 600 mm and is laid flat on the cask and clamped by the cover so as to form an upper smaller air space (1) and a lower larger one (2); FIG. 1);

(B) a cover having a diameter of 410 mm, but without a polyethylene film.

The deformation of the cover is measured as an index of the change in internal pressure. The deformation of the cask itself is assessed visually.

| Deformation of the cover and of the cask | | | |
|---|---|---|---|
| cover | | | |
| after 5 mins. | after 10 mins. | after 24h. | cask |
| Exp. A + 3,5 mm | + 1 mm | ± 0 mm (23° C.) | no deformation of the cask |
| Exp. B + 10,5 mm | + 8 mm | − 12,5 mm (23° C.) | pronounced deformation of the cask |

+ = excess pressure, convex curvature of the cover
− = partial vacuum, concave curvature of the cover The results show that the inserted polyethylene film by itself effects a pressure equalisation in the event of the formation of excess pressure or a partial vacuum and no deformation occurs, thus retaining the resistance to compression of the normal cask, which is reduced by up to 30% in a cask deformed by a partial vacuum.

EXAMPLE 2

The following tests were carried out to illustrate the improvement in the fall resistance of the filled cask in accordance with the present invention.

A. A blue polyethylene cask sealed with a cover (contents 129.3 liters) and which is flattened on two sides and has a mouth with a diameter of 36 cm, is filled with 124 kg of ordinary tap water (3). A 0.1 mm bag-shaped polyethylene film (diameter 40 cm, depth 11 cm) is laid over the contents of the cask so that the top of the film hangs over the rim of the cask and can then be folded over the rim (FIG. 2).

B. The cask is filled as in A but without using a polyethylene film.

Finally, the cask is sealed with a cover (4; P 158). In test A, a larger upper air space (1) and a smaller lower one (2) are formed. The water temperature during the tests is 21° C. In the fall tests described in more detail hereinafter, the point of impact was on the side adjacent to the tensioning lever. In test I, the cask fell onto the periphery of the flattened side at an angle of 90° to the mold parting line, whilst in test II the cast fell at an angle of 45° onto the cover edge of the flattened side again at an angle of 90° to the mold parting line.

In the individual tests, the following conditions were chosen and the indicated results obtained.

| Test | Impact area | PE film | Height of fall in m | Evaluation after fall |
|---|---|---|---|---|
| B 1) (prior art) | I | no | 1.2 | very leaky, sealing means loose, one clip slipped out of the fixing means |
| B 2) (prior art) | II | no | 1.2 | very leaky, sealing means slipped out, edge badly deformed, cask unfit for use |
| A 1) (according to the invention | I | with | 1.2 | dropwise leakage of contents, film torn at edge of peripheral portion |
| A 2) (according to the invention | II | with | 1.2 | dropwise leakage of contents, film torn at edge of peripheral portion |

EXAMPLE 3

Example 2 is repeated using a leaf-shaped polyvinyl chloride film (diameter 550 mm, thickness 0.2 mm) which is laid on the cask and pushed by hand sifficiently far into the upper air space of the cask as to form a larger upper air space ($\frac{2}{3}$) and a smaller lower one ($\frac{1}{3}$), and the overhanging part of the sheet is folded over the rim of the cask, which is then sealed in the manner described.

One using the film, results similar to those of Example 2 are obtained, i.e., no appreciable damage to the cask, which remains serviceable. In contradistinction thereto, the casks becomes seriously leaky under the same conditions in the absence of the plastic film. In particular, the cask becomes deformed in the area of the cover, so that it is no longer tight and is consequently unfit for use.

EXAMPLE 4

A blue polyethylene cask sealed with a cover (contents 129.3 liters; thickness 0.6 cm) and which is flattened on two sides and has a mouth with a diameter of 32 cm, is filled with 133 kg of a 45% aqueous solution of a hexamethylolmelamine which is etherified with methanol (density at 20° C: 1.1) A polypropylene film in the form of a welded round-bottomed bag (thickness 0.125 mm; depth 12 cm; diameter 38.4 cm) is then laid over the contents of the cask and the overhanging cylindrical, tubular part of the bag is folded over the rim. The cask is then finally sealed with a cover (4; P 158), so that the sack is clamped between the rim of the cask and the cover, and the cover is then secured with a fixing means (5) (FIG. 2). In this test, a larger upper air space (1) and a smaller lower one (2) are formed. The contents (3) are thus tightly sealed and can be transported by sea freight, as the cask is not susceptible to fluctuations of temperature and pressure, these latter being equalised. The shock and fall resistance is substantially improved in comparison to an ordinary synthetic plastics cask which is not sealed with a plastic film.

EXAMPLE 5

A cask is filled in the same way as described in Example 4, except that a round-bottomed bag, which is made by welding a round soft polyvinyl chloride film with a thickness of 0.1 mm to a tubular, cylindrical soft PVC film having a thickness of 0.1 mm, a depth of 17 cm and a diameter of 34 cm, is laid over the contents of the cask, which is then sealed in the manner described.

A cask suitable for transportation by sea is also obtained.

What is claimed is:

1. A filled synthetic plastics cask which is sealed with a cover and into the interior of which there projects a preformed flexible plastic film which is impermeable to liquid but permeable to gas and is so disposed between the cover and the upper rim of the cask that the air space between said cover and the contents of said cask is divided and the film is folded in the rim zone of the cover such that upper and lower capillaries are formed, said lower capillaries substantially permitting no egress of the contents and said upper capillaries permitting the escape of gas which has penetrated from the contents through said plastic film from inside the cask and also ensuring an internal pressure equalisation from outside.

2. The cask of claim 1, wherein the air space is divided by the construction of the cover into a smaller upper air space and a larger lower one.

3. The cask of claim 1, wherein the air space is divided by the plastic film into a larger upper air space and a smaller lower one.

4. The cask of claim 3, wherein the air space is divided by a bag-shaped plastic film.

5. The cask of claims 3 and 4, wherein the preformed plastic film consists of a tubular, cylindrical, gas-permeable plastic film having a circular cross-section being the same or larger than the inside diameter of the mouth of the cask, and said preformed plastic film, after insertion into the filled cask, is clamped at the open end between cask rim and cask cover.

6. The cask of claims 5, wherein the circular cross-section of the film is 1.01 to 1.30 times larger than the inside diameter of the mouth of the said cask and the level to which the tubular cylindrical plastic film extends inside the cask is 0.10 cm to 0.25 cm.

* * * * *